US011506384B2

(12) United States Patent
Chen

(10) Patent No.: US 11,506,384 B2
(45) Date of Patent: Nov. 22, 2022

(54) FREE-VORTEX COMBUSTOR

(71) Applicant: DYC Turbines, LLC, San Diego, CA (US)

(72) Inventor: Daih-Yeou Chen, San Diego, CA (US)

(73) Assignee: DYC Turbines, San Diego, CA (US)

( * ) Notice: Subject to any disclaimer, the term of this patent is extended or adjusted under 35 U.S.C. 154(b) by 0 days.

(21) Appl. No.: 17/481,792

(22) Filed: Sep. 22, 2021

(65) Prior Publication Data

US 2022/0003414 A1 Jan. 6, 2022

Related U.S. Application Data

(63) Continuation-in-part of application No. 16/282,367, filed on Feb. 22, 2019, now abandoned.

(51) Int. Cl.
*F23R 3/14* (2006.01)
*F23R 3/28* (2006.01)

(52) U.S. Cl.
CPC ..... *F23R 3/14* (2013.01); *F23R 3/286* (2013.01); *F23R 2900/03042* (2013.01)

(58) Field of Classification Search
CPC ..... F23R 3/04; F23R 3/06; F23R 3/08; F23R 3/12; F23R 3/14; F23R 3/34; F23R 3/32; F23R 3/60; F02C 7/26; F02C 7/264
See application file for complete search history.

(56) References Cited

U.S. PATENT DOCUMENTS 2,588,728 A 3/1952 Hundstad
2,617,255 A 11/1952 Niehus
3,064,424 A 11/1962 Tomlinson
3,572,031 A 3/1971 Szetela
3,834,159 A 9/1974 Vdoviak
3,927,835 A 12/1975 Gerrard
4,404,806 A 9/1983 Bell, III et al.
4,454,711 A * 6/1984 Ben-Porat ..... F23R 3/10 60/800
5,394,688 A * 3/1995 Amos ..... F23R 3/26 60/39.23
5,540,056 A 7/1996 Heberling et al.
5,628,192 A 5/1997 Hayes-Bradley
5,797,267 A * 8/1998 Richards ..... F23R 3/286 60/737

(Continued)

*Primary Examiner* — Todd E Manahan
*Assistant Examiner* — Thuyhang N Nguyen
(74) *Attorney, Agent, or Firm* — Diana D. Brehob; Brehob Law, PLLC

(57) ABSTRACT

A free-vortex combustor is disclosed that generates vortices which: enhance fuel air mixing, recirculate the air, provide cooling for the combustor walls, and provide low emissions and a substantially uniform exit temperature profile. The combustor is provided fuel or fuel and air through a fuel-injector which atomizes the fuel. A first air swirler couples to the fuel-injector with a prechamber wall abutting the first swirler. A second swirler abuts a downstream end of the prechamber wall. And, a main chamber abuts the second swirler. Each of the first and second swirlers have features that cause the flow to create a vortex in the prechamber and main chamber, respectively. The features creating the swirl are blades or angled orifices. The vortex causes a pressure depression along the centerline and causes backflow along the centerline that improves mixing and improves cooling.

17 Claims, 5 Drawing Sheets

(56) References Cited

U.S. PATENT DOCUMENTS

| | | | | |
|---|---|---|---|---|
| 5,950,417 | A * | 9/1999 | Robertson, Jr. | F23C 6/045 60/39.23 |
| 5,996,351 | A * | 12/1999 | Feitelberg | F23R 3/06 60/754 |
| 6,151,899 | A | 11/2000 | Park | |
| 6,453,675 | B1 * | 9/2002 | Royle | F23R 3/007 60/800 |
| 6,474,070 | B1 | 11/2002 | Danis | |
| 6,955,053 | B1 | 10/2005 | Chen et al. | |
| 6,959,550 | B2 * | 11/2005 | Freeman | F23R 3/04 60/725 |
| 7,302,801 | B2 | 12/2007 | Chen | |
| 8,316,645 | B2 | 11/2012 | Lee et al. | |
| 9,869,251 | B2 | 1/2018 | Chen | |
| 10,801,729 | B2 * | 10/2020 | Bloom | F23R 3/60 |
| 2003/0221431 | A1 * | 12/2003 | Rock | F23R 3/30 60/737 |
| 2008/0193886 | A1 * | 8/2008 | Amano | F23R 3/46 431/9 |
| 2013/0047621 | A1 | 2/2013 | Carrere | |
| 2013/0174560 | A1 | 7/2013 | Wiebe | |

* cited by examiner

FREE-VORTEX COMBUSTOR

FIELD

The present disclosure relates to continuous combustors.

BACKGROUND

Continuous combustors are well known in the industry, particularly in the field of gas turbines. There continues to be a need for a compact, inexpensive combustor with low emissions.

SUMMARY

A simple, inexpensive combustor is disclosed that includes: a fuel injector, a first air inlet ring abutting the fuel injector on a downstream end of the injector, a prechamber wall abutting the first air inlet ring, a second air inlet ring abutting a downstream end of the prechamber wall, and a main chamber wall abutting the second air inlet ring. The first and second air inlet rings each have an inner wall; an outer wall; and a plurality of blades coupled between the inner and outer walls. In an alternative embodiment, a plurality of angled orifices is defined in the air inlet ring, the angled orifices directing the flow to swirl. The air inlet ring is alternatively called a swirler.

An upstream portion of the prechamber wall has a first cylindrical wall. An upstream portion of the main chamber wall comprises a second cylindrical wall.

A downstream portion of the prechamber wall is a conical frustum with a downstream end of the conical frustum having a greater diameter than an upstream end of the conical frustum. The conical frustum has a plurality of orifices defined therein. The plurality of orifices is around a circumference of the conical frustum at a predetermined distance between the upstream end and the downstream end of the conical frustum.

The main chamber wall has: an upstream portion that comprises a first cylindrical wall, a downstream portion that comprises a second cylindrical wall of a diameter less than the first cylindrical wall, and a central portion coupled between the first and second cylindrical walls, the central portion being a conical frustum wall. A plurality of orifices is defined in the second cylindrical wall.

The combustor also has a dilution zone wall with a third air inlet ring. An upstream end of the dilution zone wall abuts a downstream end of the main chamber.

The combustor also includes a combustor housing in which the prechamber wall, the main chamber wall, and the dilution zone wall are disposed. Air provided to the combustor flows through a duct formed between an inner surface of the housing and an outer surface of the prechamber wall, the main chamber wall, and the dilution zone wall.

A prechamber is partially defined by the injector and the prechamber wall. The injector provides fuel into the prechamber at a fuel mass flow rate. Air is provided to the prechamber via the injector at a first air mass flow rate. Air is inducted into the prechamber at a second air mass flow rate. An actual air-fuel ratio in the prechamber is a sum of the first and second air mass flow rates divided by the fuel mass flow rate. The actual air-fuel ratio in the prechamber is less than a stoichiometric air-fuel ratio.

A main chamber is located within the main chamber wall. Air is inducted into the main chamber at a third air mass flow rate. Actual air-fuel ratio in the main chamber is a sum of the first, second, and third air mass flow rates divided by the fuel mass flow rate. The actual air-fuel ratio in the main chamber is greater than the stoichiometric air-fuel ratio.

The combustor has an ignitor with a tip that extends into the prechamber wall. In other embodiments, the ignitor tip extends into the main chamber wall.

The combustor also includes a mechanical compression spring that is located between at least one of: the injector and the first air inlet ring, the first air inlet ring and the prechamber wall, the prechamber wall and the second air inlet ring, the second air inlet ring and the main chamber wall, and the main chamber wall and the dilution zone wall.

A combustor is disclosed that has a fuel injector, an upstream air inlet ring abutting the fuel injector, and a prechamber wall abutting the upstream air inlet ring. An upstream portion of the prechamber wall comprises a first cylindrical wall. A downstream portion of the prechamber wall is a first conical frustum with a downstream end of the first conical frustum having a greater diameter than an upstream end of the first conical frustum.

The combustor also includes: a central air inlet ring abutting the downstream portion of the prechamber wall, and a main chamber wall abutting the central air inlet ring wherein the main chamber wall comprises three portions: an upstream portion that comprises a second cylindrical wall, a downstream portion that comprises a third cylindrical wall of a diameter less than the second cylindrical wall, and a central portion coupled between the second and third cylindrical walls. The central portion is a second conical frustum with the upstream end of the second conical frustum having a diameter substantially equal to a diameter of the second cylindrical wall. The downstream end of the second conical frustum has a diameter substantially equal to the diameter of the third cylindrical wall.

In one embodiment, the combustor has a first plurality of blades disposed in the first air inlet ring and a second plurality of blades disposed in the second air inlet ring. In another embodiment, the combustor has a first plurality of angled orifices disposed in the first air inlet ring and a second plurality of angled orifices disposed in the second air inlet ring.

The combustor also includes a dilution zone having a third air inlet ring. An upstream end of the dilution zone abuts a downstream end of the main chamber.

The combustor also includes a housing in which the prechamber, the main chamber, and the dilution zone are disposed. Air provided to the combustor flows through a duct formed between an inner surface of the housing and an outer surface of the prechamber, the main chamber, and the dilution zone.

The combustor has a compression spring disposed between the fuel injector and the prechamber or between the prechamber and the main chamber.

The first conical frustum has a first plurality of orifices; and the third cylindrical wall has a second plurality of orifices.

The combustor has an ignitor that pierces the prechamber wall and/or the main chamber wall with a tip of the injector within the prechamber and/or chamber wall, respectively.

Advantages of the present disclosure are free-vortex rings are generated at several locations along the combustor length. The free vortexes use their centrifugal force to: 1) improve fuel/air mixing by having air impinge on the fuel, 2) improve air mixing with hot gases for uniform exit temperature profile, 3) creating flow recirculation to stabilize the flame, and 4) provide film cooling for combustor liner.

Because the flow inside the combustor is swirling due to centrifugal force of upstream free-vortex rings moving outward to the combustor wall, the downstream free-vortex rings impinge on nearby fuel or fuel/air mixture for efficient mixing to provide the desired fuel/air ratio thereby better controlling and lowering emissions. This approach of free-vortex rings impinging on nearby fuel or fuel/air mixture at various combustor locations will remove fuel/air mixing uncertainties of traditional approaches which use combustor orifice size to control jet penetration for reaching fuel or fuel/air mixture.

This disclosed approach of free-vortex rings impinging on nearby fuel or fuel/air mixture can also create a recirculation zone with better control of fuel/air mixing and fuel/air ratio to promote improved flame stabilization and thereby low emissions. The film cooling function of the free-vortex rings is significantly better than traditional film cooling due to the centrifugal forces of the free-vortex rings which strictly guide the film cooling air to flow along the combustor wall.

DETAILED DESCRIPTION

As those of ordinary skill in the art will understand, various features of the embodiments illustrated and described with reference to any one of the Figures may be combined with features illustrated in one or more other Figures to produce alternative embodiments that are not explicitly illustrated or described. The combinations of features illustrated provide representative embodiments for typical applications. However, various combinations and modifications of the features consistent with the teachings of the present disclosure may be desired for particular applications or implementations. Those of ordinary skill in the art may recognize similar applications or implementations whether or not explicitly described or illustrated.

Figure 1:
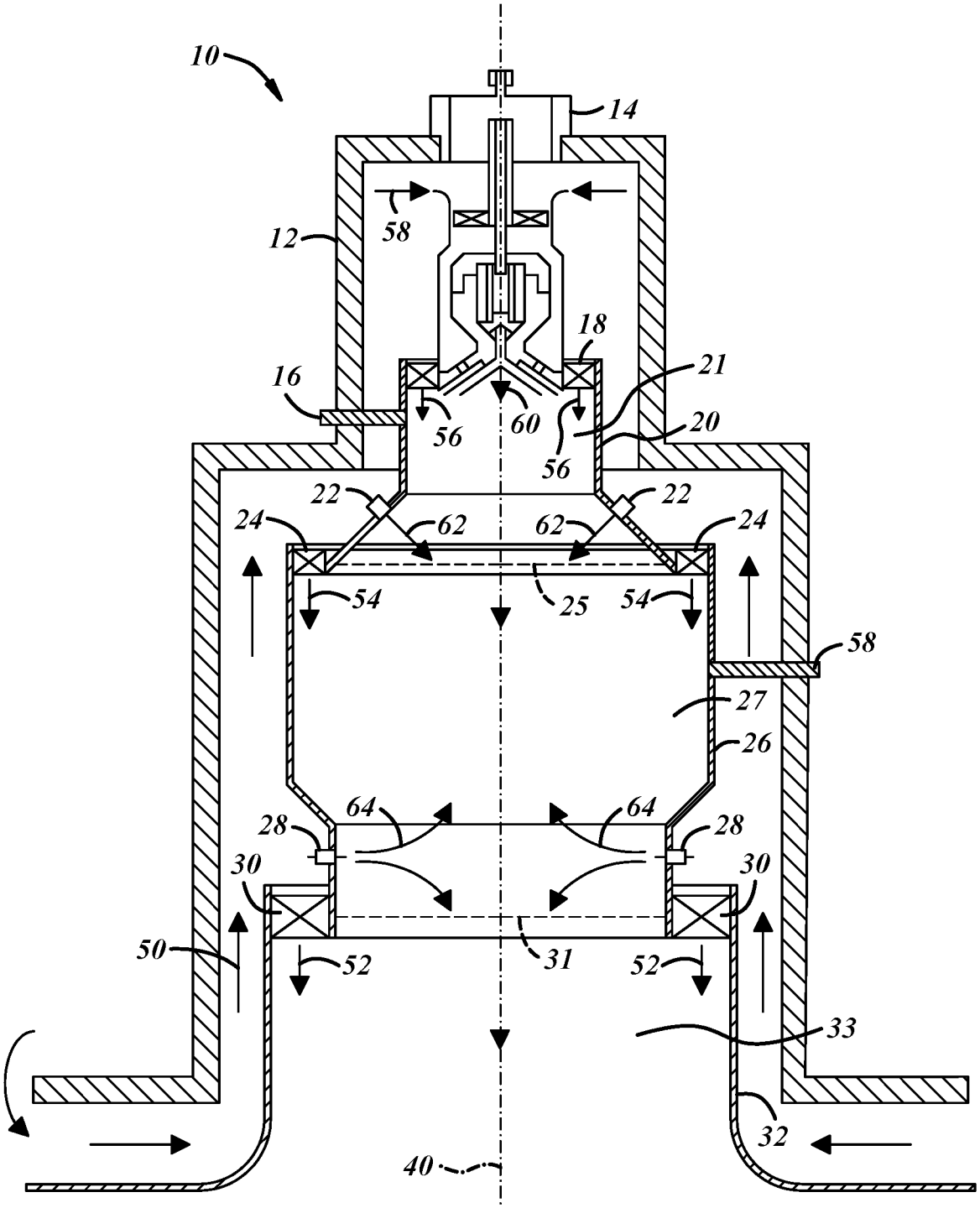
FIGS. 1-3 are cross-sections of embodiments of combustors.

A cross section of a continuous combustor 10 is shown in FIG. 1. Combustor 10 has a combustor case or combustor housing 12. An injector 14 is disposed in an upper end of combustor housing 12. In some embodiments, injector 14 is of the type taught in U.S. Pat. No. 9,869,251, which is incorporated by reference in its entirety. Alternatively, any suitable injector may be used. Liquid fuel sprays out from injector 14 as droplets. The droplets are a mist in region 60. Injector 14 is collinear with a center line 40 of combustor housing 12.

Figure 8:
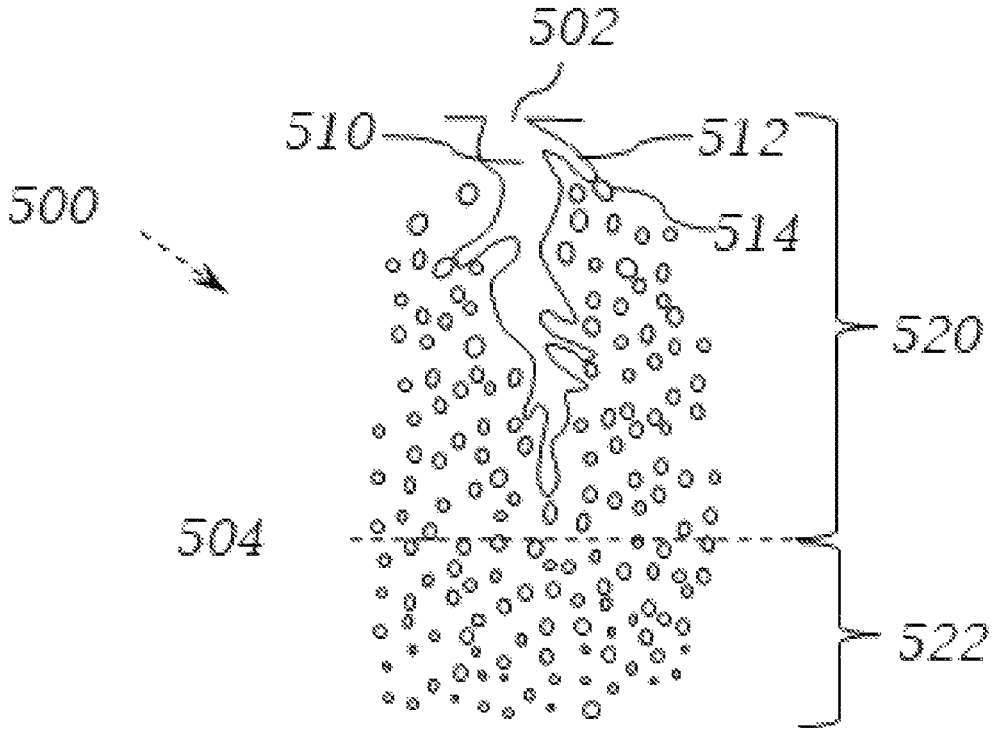
FIG. 8 illustrates droplet breakup of a liquid fuel being sprayed into a gaseous medium such as in a prechamber.

One orifice 502 of an injector is illustrated in FIG. 8. A liquid fuel core 518 exits orifice 502. Because of the high pressure in the injector, the fuel exits at high velocity and hits a wall of air in the prechamber. A fuel core 510 burrows through the air and is broken up in the process. Ligaments, such as ligament 512, form and then split off and form droplets, such as droplet 514. As the fuel continues into the air in the prechamber, larger droplets continue to break up into smaller droplets as well as get smaller in size due to the vaporization of the fuel. The velocity of the droplets reduces as decelerated by the air and due them losing their mass due to vaporization. Due to diffusion and mixing, the fuel rich areas near the droplets mix with the air to create a combustible mixture. A spray formation region 520 is nearest orifice 502 of the injector. Following spray formation region 520 is a spray region 522, which is roughly below dashed line 504.

Another type of liquid-injection is an air-blast atomizer, such as is disclosed in commonly-assigned U.S. Pat. No. 9,869,251. In the liquid-only injector, the pressures are rather high. Advantages of the air-blast atomizer are that the pressures of the air and fuel are lower and air-blast atomization is more effective at cold start than high-pressure liquid-only injection. The disadvantage of air-blast atomizer is that energy consumed in pressurizing the air. The air-blast injector or atomizer presents quite a similar picture of fuel disintegrating into droplets, into smaller droplets, vaporizing, and mixing with air as in the liquid-only injector.

It is also known to use gaseous fuels, such as hydrogen or natural gas, in which the gaseous fuel diffuses with the air, i.e., gas into gas in contrast to liquid into gas with the liquid fuel. Injection and mixing process with gaseous fuels are different for gaseous fuels that that with liquid fuels due to the need to vaporize the liquid fuel and due to the high pressure and thus high velocity that the fuel is introduced into the air. The combustor according to embodiments in the present disclosure promotes intense mixing of the fuel and air, whether the fuel is liquid or gas.

Coupled at the downstream end of injector 14 is an air inlet ring 18. Air inlet ring 18 is coupled to a prechamber wall 20. Prechamber wall 20 has a plurality of orifices 22 for inducting air. An air inlet ring 24 is coupled between prechamber wall 20 and a main chamber wall 26. Main chamber wall 26 has a plurality of orifices 28 for inducting air. An air inlet ring 30 is located between main chamber wall 26 and a dilution zone wall 32.

A prechamber 21 is partially defined by prechamber wall 20 and injector 14. A main chamber 27 is partially defined by main chamber wall 26. And, a dilution zone 33 is partially defined by a dilution zone wall 32. Prechamber 21 is loosely defined on a downstream end by a plane 25 through air inlet ring 24 and which is perpendicular to central axis 40. Plane 25 loosely defines main chamber 27 on an upstream end of main chamber 27. On a downstream end of main chamber 27, a plane 31, which goes through air inlet ring 30 and is perpendicular to central axis 40, also loosely defines main chamber 27.

FIG. 1 shows an ignitor 16 that has a tip that is in communication with prechamber 21. Ignitor 16 pierces through combustor housing 12 and prechamber wall 20. Ignitor 16 is typically used to initiate combustion during a start-up process of combustor 10. After successful ignition, ignitor 16 is deactivated. In FIG. 1, a face of ignitor 16 is flush with an inside surface of prechamber wall 20. Such configuration prevents disruption of the flow characteristics within prechamber 21. In other embodiments, ignitor 16 extends into prechamber 21. In yet other embodiments, ignitor 16 is retractable and is pulled back after ignition.

Air flow 50 passes between an interior surface of combustor housing 12 and an exterior surface of walls 20, 26, and 32. Some of air flow 50 is inducted into dilution zone 33 through air inlet ring 30, as indicated by arrows 52. Another portion of air flow 50 is inducted into main chamber 27 through orifices 28. Such air flow is shown by arrows 64. Additionally, a portion of air flow 50 is inducted through air inlet ring 24 as shown by arrows 54 and through orifices 22 as indicated by arrows 62 into prechamber 21. A portion of air flow 50 is inducted through air inlet ring 18 as shown by arrows 56.

Figure 2:
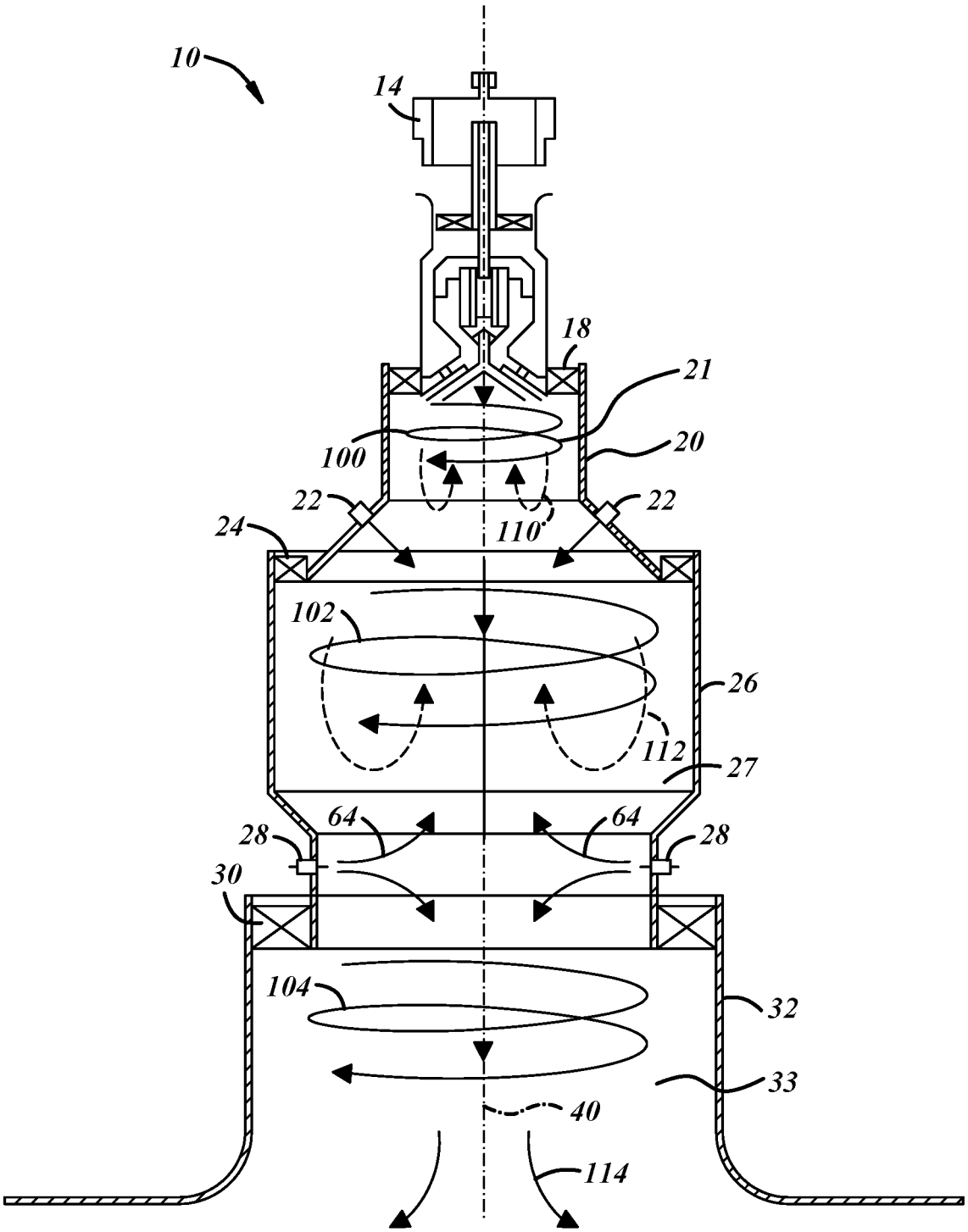

In some embodiments air inlet rings 18, 24, and 30 have blades that direct the air flow into a swirling flow. Such swirlers are discussed in more detail below. In embodiments where air inlet ring 18 is a swirler, a vortex 100 is set up in prechamber 21, as illustrated in FIG. 2. Flow within prechamber 21 is moving downward, although with a vortical movement; thus vortex 100 is shown as a helix. Vortex 100 causes a slight pressure depression along central axis 40 which causes some of the flow in vortex 100 to roll up as shown by dashed arrows 110. Such backward flow as shown by arrows 110 greatly improves mixing and combustion of the fuel and air in prechamber 21.

In some embodiments, a plurality of orifices 22 are formed around the periphery of prechamber wall 20. Orifices 22 are arranged so that the air flowing through them is not directed to the center, instead more tangent to the prechamber wall 20, in a direction that strengthens vortex 100.

Air is also inducted through air inlet ring 24 into main chamber 27. In embodiments where air inlet ring 24 is a swirler, air inlet ring 24 causes the flow to enhance vortex 100 which persists into main chamber 27. The resulting vortex 102 is illustrated as helix because the flow moves downward to dilution zone 33. A pressure depression near center line 40 of main chamber 27 causes some roll up of the flow as shown by arrows 112 which enhance mixing in main chamber 27.

More air is inducted through orifices 28 formed in main chamber wall 26. These orifices can be placed around the periphery of main chamber wall 26 and oriented to enhance vortex 102.

Continuing to refer to FIG. 2, air is inducted through another air inlet ring 30, which when a swirler, further adds to vortical motion of vortex 102. Such vortical flow of vortex 104 is illustrated as a helix in dilution zone 33. Due to the high amount of flow through dilution zone 30, no substantial roll up flow is formed. Flow 114 from dilution zone 33 exits combustor 10. In a gas turbine application, flow 114 is inducted into a stator upstream of a turbine.

Figure 3:
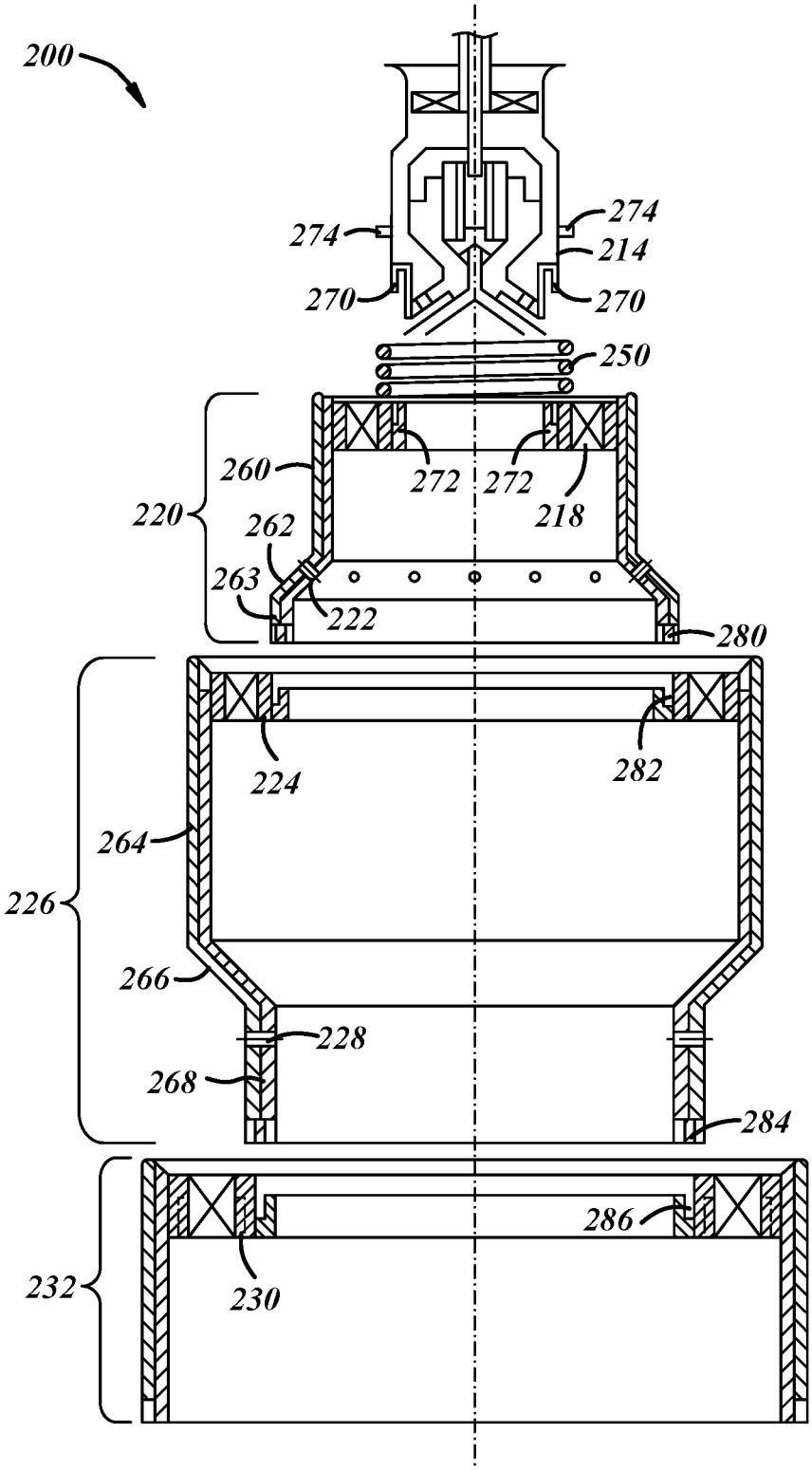

An exploded view of a combustor 200 is shown in FIG. 3. An injector 214 is pressed onto an air inlet ring 218 with a mechanical spring 250 disposed there between. Air inlet ring 218 is coupled to a prechamber wall 220 that includes a cylindrical portion 260, a frustum portion 262 that is downstream of the cylindrical portion, and a cylindrical portion 263 downstream of frustum portion 262. The diameter of cylindrical portion 260 is of a smaller diameter than the diameter of cylindrical portion 263. A plurality of orifices 222 are defined in the frustum portion 262 of prechamber wall 220. The orifices are formed in the wall in a manner to add to the vortex set up by air inlet ring 218.

Frustum portion 262 of prechamber wall 220 engages with an air inlet ring 224. Air inlet ring 224 is coupled to a main chamber wall 226. Main chamber wall 226 includes three sections, from upstream to downstream: a cylindrical portion 264, a frustum portion 266, and a cylindrical portion 268. The diameter of cylindrical portion 268 is smaller than the diameter of cylindrical portion 264.

Cylindrical portion 268 of main chamber wall 226 engages with an air inlet ring 230. Air inlet ring 230 engages with a dilution zone wall 232. Air inlet ring 230 has a groove 286 that engages with a lip 284 in main chamber wall 226. A groove 282 on air inlet ring 224 engages with a lip 280 in the downstream end of prechamber 220.

In FIG. 3, air inlet ring 218 is shown coupled to prechamber 220, possibly by welding or any other suitable fastening technique. Alternatively, air inlet ring and 218 could couple to prechamber 220 via a groove and lip fastener system similar to 280 and 282. One of the difficulties in a combustor is uneven expansion of the various elements, particularly during starting and warmup of the device. The reason for the free-floating joints and mechanical spring 250 pushing them joints together is to accommodate a small amount of relative movement without stressing the components that are coupled together. A solid connection could lead to high stresses developing and premature failure. Joints in the system could be any suitable joint type that allows some relative movement of the abutting elements. Some of the joints that have less relative movement are solidly coupled via a weld or other bond. Although not shown in FIG. 3, two end pieces of the combustion (injector 214 and dilution zone wall 232) are held fixed. When injector 214, dilution zone wall 232, and all the pieces between expand, the spring compresses to hold them together more tightly. Mechanical spring 250 is shown between injector 214 and air inlet ring 218. When assembled, mechanical spring abuts a ring 274 that extends outwardly from injector 214 and air inlet ring 218. Injector 214 couples to prechamber 220 when connector 270 engages with connector 272 during assembly. In other embodiments, a mechanical spring is provided at a different junction in the combustor. In even other embodiments, a plurality of joints in the combustor are provided with mechanical compression springs. In yet even other embodiments, a tension spring is used between the two end pieces (injector 214 and dilution zone wall 232) to pull them together, which pulls all the free-floating joints in the system to pull together.

Figure 4:
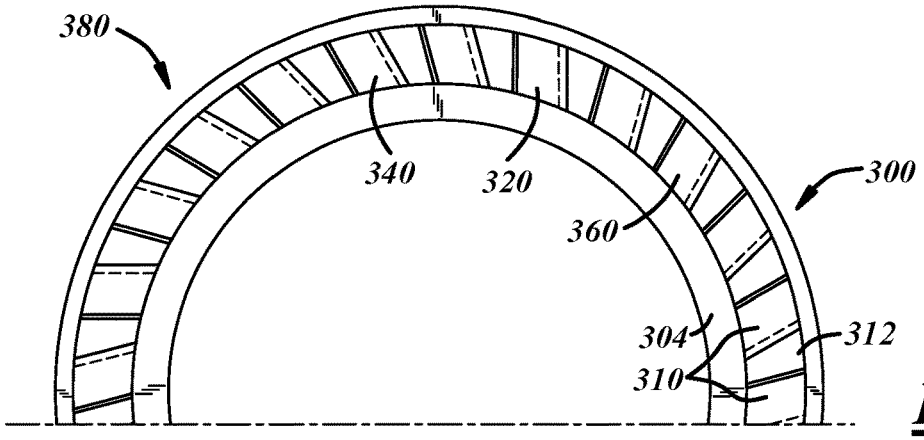
FIGS. 4 and 5 are plan and isometric views of a blade-type swirler, respectively.

An embodiment of an air inlet ring 300 that swirls the flow (also referred to as a swirler) is shown in FIG. 4. Air inlet ring 300 has an outer wall 302 and an inner wall 304 with blades that extend between walls 302 and 304. Between adjacent blades 310 is an opening 312.

Figure 5:
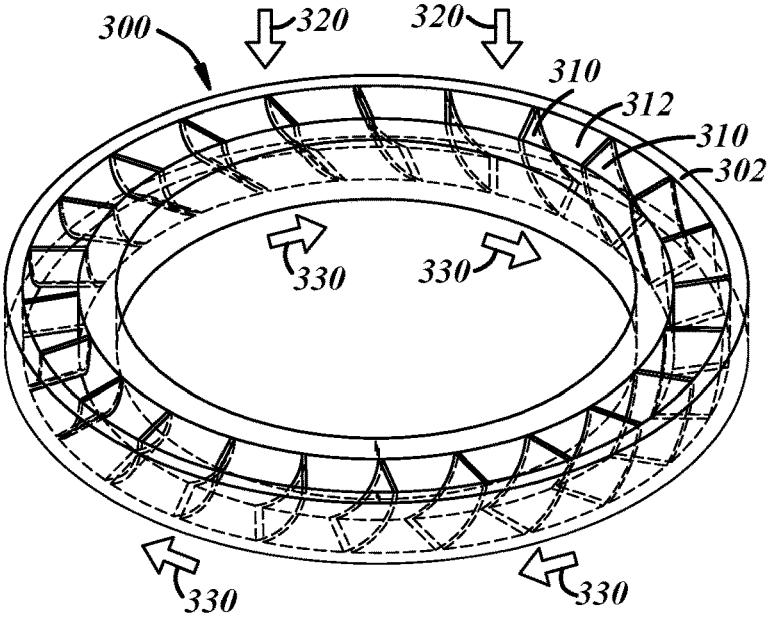

An isometric view of inlet ring 300 is shown in FIG. 5. The curvature of blades 310 disposed between walls 302 and 304 is visible. Between adjacent blades 310 are openings 312. A swirling flow 330 is imparted to downward inlet air flow 320 due to blades 310 guiding the flow.

Figure 6:
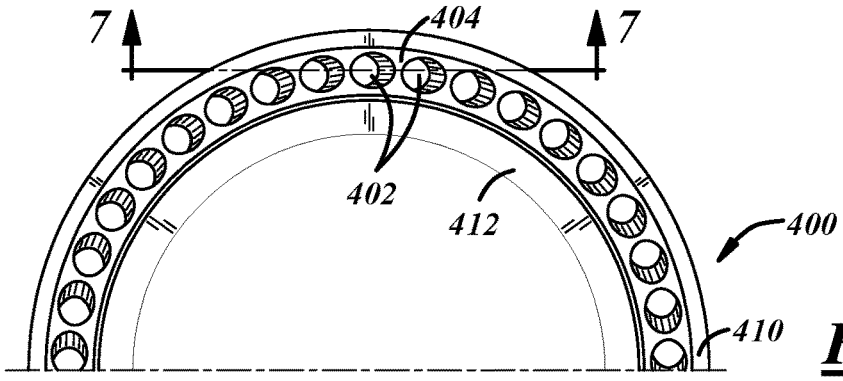
FIGS. 6 and 7 are plan and side views of sections of an orifice-type swirler, respectively.
Figure 7:
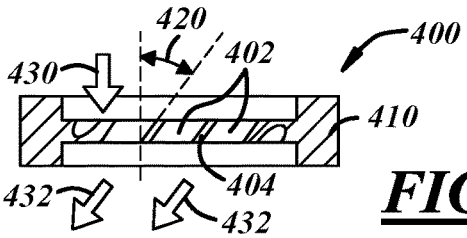

An alternative air inlet ring 400 that swirls the flow is shown in FIG. 6. Air inlet ring 400 has an outer wall 410 and an inner wall 412 with a plurality of orifices 402 defined in the web material between walls 410 and 412. Bridges 404 are between adjacent orifices 402. A cross section 7-7 of FIG. 6 is shown in FIG. 7, where angle 420 indicates the angle with which orifices 402 are canted with respect to the direction of incoming flow 430. Outlet flow from air inlet ring 400 has a swirling component as illustrated by arrows 432. The canted orifices of FIGS. 6 and 7 or the blades of FIGS. 4 and 7 are collectively called deflectors herein.

The combustor in any of FIGS. 1-3 may be operated in two modes: lower output and high output. As is well-known by those skilled in the art, to avoid producing nitrogen oxides (NOx) from combustion, it is important to operate away from a stoichiometric air-fuel ratio. In reality, peak NOx formation occurs just lean of stoichiometric. In the lower output mode, the prechamber is operated lean enough of stoichiometric to avoid the high NOx formation condition. Air flows rates are lessened to ensure that the resulting ratio, although lean, is stably combustible, i.e., avoid flame out. No meaningful amount of combustion occurs in the main chamber and dilution zone. The exhaust products are further diluted in both the main chamber and the dilution zone. In the higher output mode, the prechamber is operated rich of stoichiometric. Because there is not enough air to burn the fuel, the combustion products from the prechamber includes CO, unburned hydrocarbons, and partially burned hydrocarbons. The desire is that these combustibles burn to completion in the main chamber. By diluting the exhaust products from the prechamber (via air coming in through orifices and an air inlet ring), the stoichiometry from the prechamber, which is rich of stoichiometric, quickly passes through stoichiometric and mixes out to a lean stoichiometry. With sufficient air, CO and incompletely burned hydrocarbons combust.

While the best mode has been described in detail with respect to particular embodiments, those familiar with the art will recognize various alternative designs and embodiments within the scope of the following claims. While various embodiments may have been described as providing advantages or being preferred over other embodiments with respect to one or more desired characteristics, as one skilled in the art is aware, one or more characteristics may be compromised to achieve desired system attributes, which depend on the specific application and implementation. These attributes include, but are not limited to: cost, strength, durability, life cycle cost, marketability, appearance, packaging, size, serviceability, weight, manufacturability, ease of assembly, etc. The embodiments described herein that are characterized as less desirable than other embodiments or prior art implementations with respect to one or more characteristics are not outside the scope of the disclosure and may be desirable for particular applications.

I claim:

1. A continuous combustor, comprising:

a fuel injector;

a first air inlet ring surrounding a downstream end of the fuel injector;

a prechamber wall abutting the first air inlet ring;

a second air inlet ring abutting a downstream end of the prechamber wall; and a main chamber wall abutting the second air inlet ring, wherein:

the first and second air inlet rings each define an annulus by an inner wall and an outer wall;

the first and second air inlet rings have a plurality of flow deflectors disposed between the respective inner and outer walls of the first and second air inlet rings;

the flow deflectors impart a swirling flow to air passing therethrough;

air passing through the first air inlet ring is provided into the prechamber; and the prechamber wall comprises a cylindrical portion and a conical frustum portion downstream of the cylindrical portion;

a downstream end of the conical frustum portion of the prechamber wall has a greater diameter than an upstream end of the conical frustum of the prechamber;

the downstream end of the prechamber abuts with the inner wall of the second air inlet ring;

the main chamber wall comprises three portions: an upstream portion that comprises a first cylindrical wall, a downstream portion that comprises a second cylindrical wall of a diameter less than the first cylindrical wall, and a central portion coupled between the first and second cylindrical walls, the central portion being a conical frustum wall, and the first cylindrical wall of the main chamber wall abuts the outer wall of the second air inlet ring.

2. The combustor of claim 1 wherein:

the conical frustum of the prechamber has a plurality of orifices defined therein; and the plurality of orifices is around a circumference of the conical frustum at a predetermined distance between the upstream end and the downstream end of the conical frustum.

3. The combustor of claim 1, further comprising: a plurality of orifices defined in the second cylindrical wall of the main chamber.

4. The combustor of claim 1, further comprising:

a dilution zone wall; and a third air inlet ring wherein:

a downstream end of the main chamber wall abuts the third air inlet ring;

an upstream end of the dilution zone wall abuts the third air inlet ring;

a dilution zone is contained within the dilution zone wall; and air passing through the third air inlet ring is provided to the dilution zone.

5. The combustor of claim 4, wherein the third air inlet ring comprises: an inner wall; an outer wall; and a plurality of flow deflectors disposed between the inner wall and the outer wall.

6. The combustor of claim 4, further comprising:

a combustor housing in which the prechamber wall, the main chamber wall, and the dilution zone wall are disposed, wherein air provided to the combustor flows through a duct formed between an inner surface of the housing and an outer surface of the prechamber wall, the main chamber wall, and the dilution zone wall.

7. The combustor of claim 1, further comprising:

a fuel injector disposed in the combustor with a tip of the injector in fluidic communication with the prechamber, wherein:

the prechamber is partially defined by the prechamber wall;

the fuel injector provides fuel into the prechamber at a fuel mass flow rate;

air is provided to the prechamber via the fuel injector at a first air mass flow rate;

air is inducted into the prechamber at a second air mass flow rate;

an actual air-fuel ratio in the prechamber is a sum of the first and second air mass flow rates divided by the fuel mass flow rate; and the actual air-fuel ratio in the prechamber is less than a stoichiometric air-fuel ratio.

8. The combustor of claim 7 wherein:

a main chamber is located within the main chamber wall;

air is inducted into the main chamber at a third air mass flow rate;

actual air-fuel ratio in the main chamber is a sum of the first, second, and third air mass flow rates divided by the fuel mass flow rate; and the actual air-fuel ratio in the main chamber is greater than the stoichiometric air-fuel ratio.

9. The combustor of claim 1, further comprising: an ignitor wherein a tip of the ignitor extends through one of the prechamber wall and the main chamber wall.

10. A continuous combustor, comprising:

first, second, and third air inlet rings;

a prechamber partially defined by a prechamber wall, the prechamber wall having an upstream portion that is cylindrical coupled a downstream portion that is a conical frustum; and a main chamber partially defined by a main chamber wall, the main chamber wall having an upstream portion that is cylindrical and a downstream portion that is cylindrical, wherein:

an upstream end of the prechamber wall abuts an outer wall of the first air inlet ring;

a downstream end of the conical frustum portion of the prechamber wall abuts an inner wall of the second air inlet ring;

an upstream end of the main chamber wall abuts an outer wall of the second air inlet ring;

the downstream end of the downstream portion of the main chamber wall abuts an inner wall of the third air inlet ring;

the upstream cylindrical portion of the main chamber has a first diameter;

the downstream cylindrical portion of the main chamber has a second diameter;

the first diameter is greater than the second diameter;

the main chamber wall further comprises a central portion that is disposed between the upstream cylindrical portion and the downstream cylindrical portion; and the central portion of the main chamber wall is a conical frustum having the first diameter at an upstream end and the second diameter at a downstream end.

11. The continuous combustor of claim 10, further comprising:

a fuel injector coupled to the combustor with an outlet end of the fuel injector in fluidic communication with the prechamber.

12. The continuous combustor of claim 10, further comprising:

a dilution zone having a dilution zone wall that abuts the outer wall of the third air inlet ring.

13. The continuous combustor of claim 11, wherein the conical frustum of the prechamber has a plurality of orifices defined therein.

14. The combustor of claim 11, further comprising: a plurality of orifices defined in the downstream cylindrical portion of the main chamber wall.

15. The combustor of claim 11 wherein: the first and second air inlet rings each comprise:

an inner wall and an outer wall that define an annulus; and a plurality of angled orifices defined in a portion of each of the first and second air inlet rings between the respective inner and outer walls, a centerline of the angled orifices forming a nonzero angle with a centerline of the combustor.

16. The combustor of claim 11, further comprising: a compression spring disposed between the fuel injector and the first air inlet ring.

17. The combustion of claim 10, further comprising: a compression spring disposed between the prechamber and the main chamber.

* * * * *